US009803332B2

(12) United States Patent
Tanaka et al.

(10) Patent No.: US 9,803,332 B2
(45) Date of Patent: Oct. 31, 2017

(54) EXCAVATION BUCKET AND WORK VEHICLE

(71) Applicant: KOMATSU LTD., Tokyo (JP)

(72) Inventors: Daijirou Tanaka, Hirakata (JP); Tatsuo Aira, Hirakata (JP)

(73) Assignee: KOMATSU LTD., Tokyo (JP)

( * ) Notice: Subject to any disclaimer, the term of this patent is extended or adjusted under 35 U.S.C. 154(b) by 147 days.

(21) Appl. No.: 14/771,886

(22) PCT Filed: Feb. 19, 2015

(86) PCT No.: PCT/JP2015/054655

§ 371 (c)(1),
(2) Date: Sep. 1, 2015

(87) PCT Pub. No.: WO2016/132515

PCT Pub. Date: Aug. 25, 2016

(65) Prior Publication Data

US 2016/0369475 A1 Dec. 22, 2016

(51) Int. Cl.

| | |
|---|---|
| ***E02F 9/26*** | (2006.01) |
| ***E02F 3/40*** | (2006.01) |
| ***E02F 5/14*** | (2006.01) |
| ***E02F 3/43*** | (2006.01) |
| ***E02F 3/32*** | (2006.01) |

(52) U.S. Cl.

CPC ..... *E02F 3/40* (2013.01); *E02F 3/32* (2013.01); *E02F 3/435* (2013.01); *E02F 5/145* (2013.01); *E02F 9/26* (2013.01); *E02F 9/264* (2013.01)

(58) Field of Classification Search

CPC ..... E02F 5/145; E02F 9/26

See application file for complete search history.

(56) References Cited

U.S. PATENT DOCUMENTS

| | | | | |
|---|---|---|---|---|
| 9,562,340 | B2 * | 2/2017 | Yoshida | E02F 3/40 |
| 2012/0301258 | A1 * | 11/2012 | Nagata | E02F 3/40 414/723 |

FOREIGN PATENT DOCUMENTS

| | | | | |
|---|---|---|---|---|
| JP | 56-100555 | U | | 8/1981 |
| JP | 08177075 | A | * | 7/1996 |
| JP | 11-43964 | A | | 2/1999 |
| JP | 11043964 | A | * | 2/1999 |
| JP | 11-303123 | A | | 11/1999 |
| JP | 11303123 | A | * | 11/1999 |

(Continued)

*Primary Examiner* — Gerald McClain

(74) *Attorney, Agent, or Firm* — Global IP Counselors, LLP

(57) ABSTRACT

An excavation bucket includes a bottom face part, a rear face part, a pair of opposing side wall parts, teeth, a bracket, and a target penetration depth display component. The target penetration depth display component is provided around the teeth and near an end of the side wall part that forms an edge of an opening, and displays the target penetration depth. A wrist radius is an imaginary line segment connecting a center of a first hole in the bracket and the distal end of the teeth in side view. The target penetration depth display component is provided to an inside of at least one of the pair of opposing side wall parts and at a position of the side wall part corresponding to a position that has moved along the imaginary line segment from the distal end of the teeth by a specific proportional length of the wrist radius.

10 Claims, 13 Drawing Sheets

(56) References Cited

FOREIGN PATENT DOCUMENTS

| | | | | |
|---|---|---|---|---|
| JP | 2000-328530 | A | | 11/2000 |
| JP | 2000328530 | A | * | 11/2000 |
| JP | 2003336281 | A | * | 11/2003 |
| WO | 2011/049061 | A1 | | 4/2011 |

* cited by examiner

EXCAVATION BUCKET AND WORK VEHICLE

CROSS-REFERENCE TO RELATED APPLICATIONS

This application is a U.S. National stage application of International Application No. PCT/JP2015/054655, filed on Feb. 19, 2015.

BACKGROUND

Field of the Invention

The present invention relates to an excavation bucket, and to a work vehicle equipped with the same.

Background Information

A hydraulic excavator, which is an example of a work vehicle, uses an excavation bucket attached to the distal end of an arm to excavate the ground, transport earth, and so forth. Typical excavation work performed with a hydraulic excavator involves a single excavation step that has three steps: 1) penetrating the ground with the distal end of the excavation bucket by rotating the bucket, 2) excavating in a straight line horizontally using the arm or the like while maintaining the depth of penetration of the excavation bucket into the ground and its posture, and 3) raising the excavation bucket.

With one configuration that has been disclosed for an excavation bucket used in excavation work such as this, an indicator that displays the desired excavation depth is provided to the side wall of the excavation bucket in order to perform the excavation at a specific, uniform depth for excavation for foundations (see Japanese Laid-Open Utility Model S56-100555, for example). The indicator sticks out from the side wall, and is made up of a main body marked with graduations, an indicator piece whose position can be adjusted, and so forth. The excavation for foundations here is usually completed by going through a number of excavation steps. To put this directly, the indicator piece indicates the construction depth, and when the depth of excavation performed by the excavation work reaches the construction depth, the work is halted and the excavation goes no deeper.

SUMMARY

Problem to be Solved by the Invention

However, the following problem is encountered in excavation work with a hydraulic excavator.

As discussed above, the excavation work performed with a hydraulic excavator includes a step of linear excavation after the step of using the excavation bucket to penetrate the ground. The excavation depth during this work is determined by the depth of bucket penetration into the ground as a result of rotating the excavation bucket in the first step. An inexperienced operator may unwittingly go too deep when using the excavation bucket to penetrate the ground.

Even if an attempt is made to use the indicator piece of the excavation bucket in the above-mentioned Japanese Laid-Open Utility Model S56-100555 as a marker of the proper penetration depth in an effort to deal with this problem encountered in excavation work, it will not serve well as a marker of penetration depth. Specifically, in excavation work for foundations, since the work is halted once the excavation depth reaches the construction depth, the indicator piece barely touches the soil, but during excavation work in which the goal is to load soil efficiently, the indicator piece is touching the soil almost all the time.

Because the indicator discussed in Japanese Laid-Open Utility Model S56-100555 sticks out from the side wall of the excavation bucket, soil or the like tends to adhere to the indicator piece during excavation work, so there is the risk that the operator will be unable to see the indicator piece or the graduations.

Accordingly, even if the indicator discussed in Japanese Laid-Open Utility Model S56-100555 is used, the indicator piece is hard to see, and an inexperienced operator will not be able to carry out the excavation work efficiently.

Taking the problems encountered with conventional excavation buckets into account, it is an object of the present invention to provide an excavation bucket and a work vehicle with which efficient excavation work is possible regardless of how experienced the operator is.

Means for Solving Problem

The excavation bucket pertaining to a first exemplary embodiment of the present invention is attached to the arm of a work implement and is used to excavate material by penetrating into the excavation material, said excavation bucket comprising a bottom face part, a rear face part, a pair of opposing side wall parts, a cutting blade, a bracket, and a target penetration depth display component. The bottom face part has a shape that is curved in side view. The rear face part is linked to the bottom face part. The side wall parts cover sides of a space bounded by the bottom face part and the rear face part. The cutting blade is fixed to an end of the bottom face part that forms an edge of the opening of a space formed by the pair of side wall parts and the bottom face part and rear face part. The bracket is fixed to the rear face part and has a hole formed in it into which is inserted an attachment pin for attaching to the arm. The target penetration depth display component is provided around the cutting blade and near an end of the side wall part that forms the edge of the opening, and displays a target penetration depth into the material. A wrist radius is an imaginary line segment that connects a center of the hole in the bracket and a distal end of the cutting blade in side view. The target penetration depth display component is provided to an inside of at least one of the pair of opposing side wall parts and at a position of the side wall part corresponding to a position that has moved along the imaginary line segment from the distal end toward the hole by a specific proportional length of the wrist radius.

The excavation bucket pertaining to a second exemplary embodiment of the present invention is the excavation bucket pertaining to the first exemplary embodiment of the present invention, wherein the specific proportion of the wrist radius is 0.5 or less.

The excavation bucket pertaining to a third exemplary embodiment of the present invention is the excavation bucket pertaining to the second exemplary embodiment of the present invention, wherein the specific proportion of the wrist radius is at least 0.25 and no more than 0.30.

The excavation bucket pertaining to a fourth exemplary embodiment of the present invention is the excavation bucket pertaining to the first exemplary embodiment of the present invention, wherein the target penetration depth display component is provided to the inside of both of the opposing side wall parts.

The excavation bucket pertaining to a fifth exemplary embodiment of the present invention is the excavation bucket pertaining to any of the first to fourth exemplary embodiments of the present invention, wherein the bottom face part has a front lip. The front lip is disposed on the edge side, and the cutting blade is fixed thereto. The side wall parts have a side lip and a side plate. The side lips are disposed on the edge side and are provided to connect the front lip and the rear face part. The side plates are provided between the side lips and the bottom face part and the rear face part. The target penetration depth display component is provided to the side lips.

The excavation bucket pertaining to a sixth exemplary embodiment of the present invention is the excavation bucket pertaining to any of the first to fourth exemplary embodiments of the present invention, wherein the bottom face part has a front lip. The front lip is disposed on the edge side, and the cutting blade is fixed thereto. The side wall parts have a side lip, a side plate, and a shroud or a side cutter. The side lip is disposed on the edge side and is provided so as to connect the front lip and the rear face part. The side plate is provided between the side lip and the bottom face part and the rear face part. A plate-like member is fixed to the side lip. The target penetration depth display component is provided to the shroud or the side cutter.

The excavation bucket pertaining to a seventh exemplary embodiment of the present invention is the excavation bucket pertaining to the first exemplary embodiment of the present invention, wherein the position of the side wall part corresponding to a position that has moved along the imaginary line segment from the distal end toward the hole by a specific proportional length of the wrist radius is a position at which a straight line, which is perpendicular to the imaginary line segment and passes through a position on the imaginary line segment, intersects the side wall part.

The excavation bucket pertaining to an eighth exemplary embodiment of the present invention is the excavation bucket pertaining to any of the first to seventh exemplary embodiments of the present invention, wherein the target penetration depth display components have a member that serves as a marker and is fixed to the side wall part, a notch formed in the side wall part, a protrusion formed in the side wall part, or a hole formed in the side wall part.

The excavation bucket pertaining to a ninth exemplary embodiment of the present invention is attached to the arm of a work implement and is used to excavate material by penetrating into the excavation material. The excavation bucket includes a bottom face part, a rear face part, a pair of opposing side wall parts, a cutting blade, a bracket, and target penetration depth display component. The bottom face part has a shape that is curved in side view. The rear face part is linked to the bottom face part. The side wall parts cover sides of a space bounded by the bottom face part and the rear face part. The cutting blade is fixed to an end of the bottom face part that forms an edge of the opening of a space formed by the pair of side wall parts and the bottom face part and rear face part. The bracket is fixed to the rear face part and has a hole formed in it into which is inserted an attachment pin for attaching to the arm. The target penetration depth display component is provided around the cutting blade and near an end of the side wall part that forms the edge of the opening, and display a target penetration depth into the material. The target penetration depth display components display a penetration depth such that the fill ratio of the excavation bucket will be at least 88% and no more than 105%.

The work vehicle pertaining to a tenth exemplary embodiment of the present invention comprises a vehicle body, a boom, an arm, and the excavation bucket according to any of the first to ninth exemplary embodiments of the present invention. The boom is attached to the vehicle body. The arm is attached to the boom. The excavation bucket is attached to the arm.

Effects of the Invention

The present invention provides an excavation bucket and a work vehicle with which efficient excavation work is possible regardless of how experienced the operator is.

DETAILED DESCRIPTION OF EXEMPLARY EMBODIMENTS

The work vehicle pertaining to an exemplary embodiment of the present invention will now be described through reference to the drawings.

1. Configuration 1-1. Overall Configuration of Hydraulic Excavator

Figure 1:
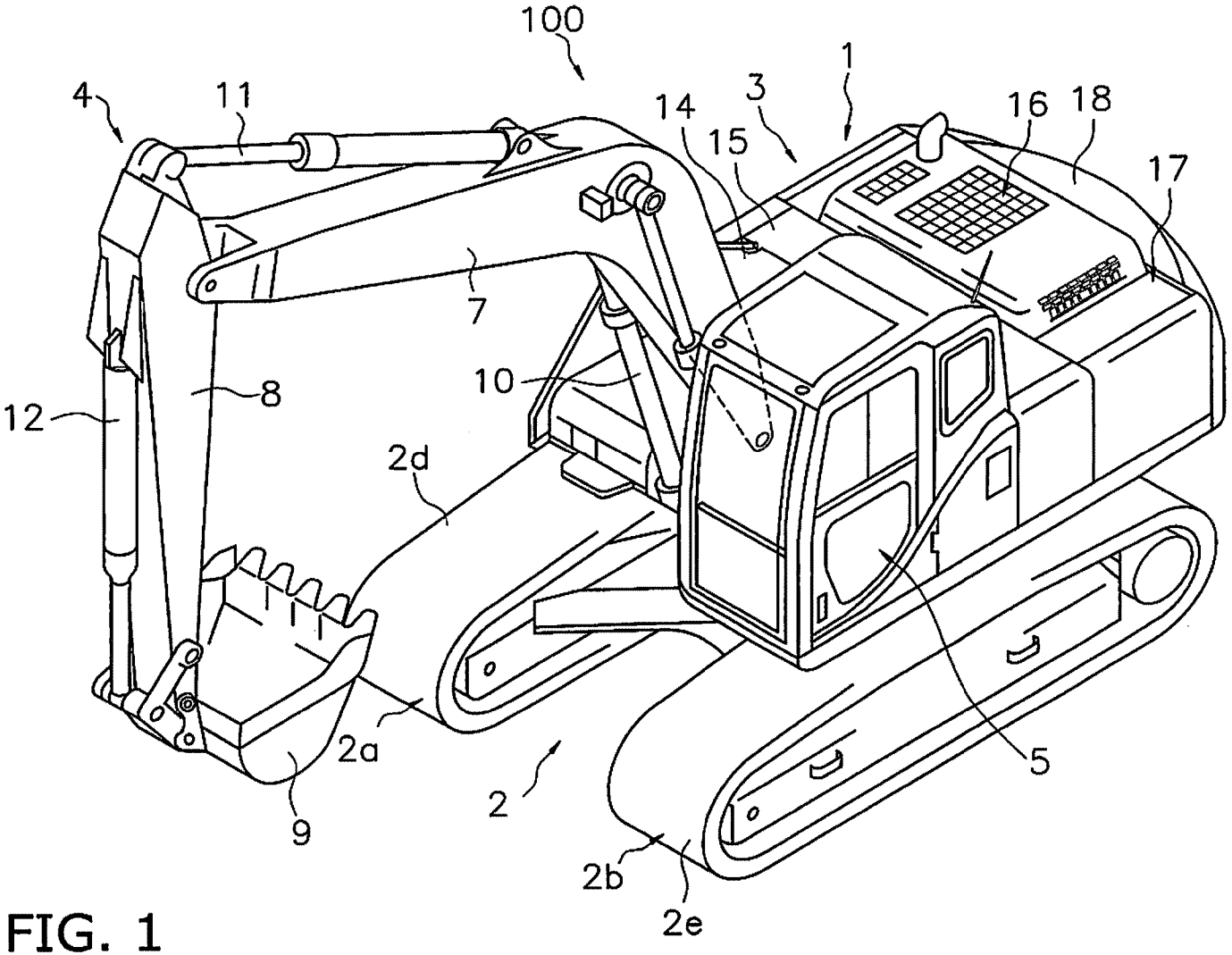
FIG. 1 is an oblique view of a hydraulic excavator in an exemplary embodiment pertaining to the present invention.

FIG. 1 shows a hydraulic excavator 100 pertaining to an exemplary embodiment of the present invention. This hydraulic excavator 100 comprises a vehicle body 1 and a work implement 4.

The vehicle body 1 has a traveling unit 2 and a revolving unit 3. The traveling unit 2 has a pair of drive units 2*a* and 2*b*. The drive units 2*a* and 2*b* have crawler belts 2*d* and 2*e*. The crawler belts 2*d* and 2*e* are driven by drive force from an engine, and this propels the hydraulic excavator 100.

The revolving unit 3 is installed on the traveling unit 2. The revolving unit 3 is provided to be capable of revolving with respect to the traveling unit 2. A cab 5 is provided as a driver compartment at a position on the front left side of the revolving unit 3. In this description of the overall configuration, the "forward and backward direction" means the forward and backward direction of the cab 5. Furthermore, the forward and backward direction of the vehicle body 1 coincides with the forward and backward direction of the cab 5, that is, the revolving unit 3. The left and right direction, or the side direction, means the width direction of the vehicle body 1.

The revolving unit 3 has a fuel tank 14, a hydraulic fluid tank 15, an engine compartment 16, an accommodation compartment 17, and a counterweight 18. The fuel tank 14 holds fuel for driving the engine (discussed below). The fuel tank 14 is disposed ahead of the hydraulic fluid tank 15. The hydraulic fluid tank 15 holds hydraulic fluid that is discharged from a hydraulic pump (not shown) and supplied to hydraulic cylinders 10, 11, and 12. An engine is mounted in the interior of the engine compartment 16. The accommodation compartment 17 is disposed behind the cab 5, and is disposed aligned with the engine compartment 16 in the vehicle width direction. The interior of the accommodation compartment 17 has a holding space for holding a radiator and a radiator fan (not shown) that cool the engine. The counterweight 18 is disposed behind the revolving unit 3.

The work implement 4 has a boom 7, an arm 8, and an excavation bucket 9, and is attached at a position in the front center of the revolving unit 3. More precisely, the work implement 4 is disposed on the right side of the cab 5. The proximal end of the boom 7 is rotatably linked to the revolving unit 3. The distal end of the boom 7 is rotatably linked to the proximal end of the arm 8. The distal end of the arm 8 is rotatably linked to the excavation bucket 9. The excavation bucket 9 is attached to the arm 8 so that its opening can face in the direction of the vehicle body 1 (rearward). A hydraulic excavator in which the excavation bucket 9 is attached in this orientation is called a backhoe. The hydraulic cylinders 10, 11, and 12 (the boom cylinder 10, the arm cylinder 11, and the bucket cylinder 12) are disposed to correspond to the boom 7, the arm 8, and the excavation bucket 9, respectively. The work implement 4 is driven by driving these hydraulic cylinders 10, 11, and 12. Work such as excavation is performed in this way.

1-2. Simplified Configuration of Excavation Bucket 9

Figure 2:
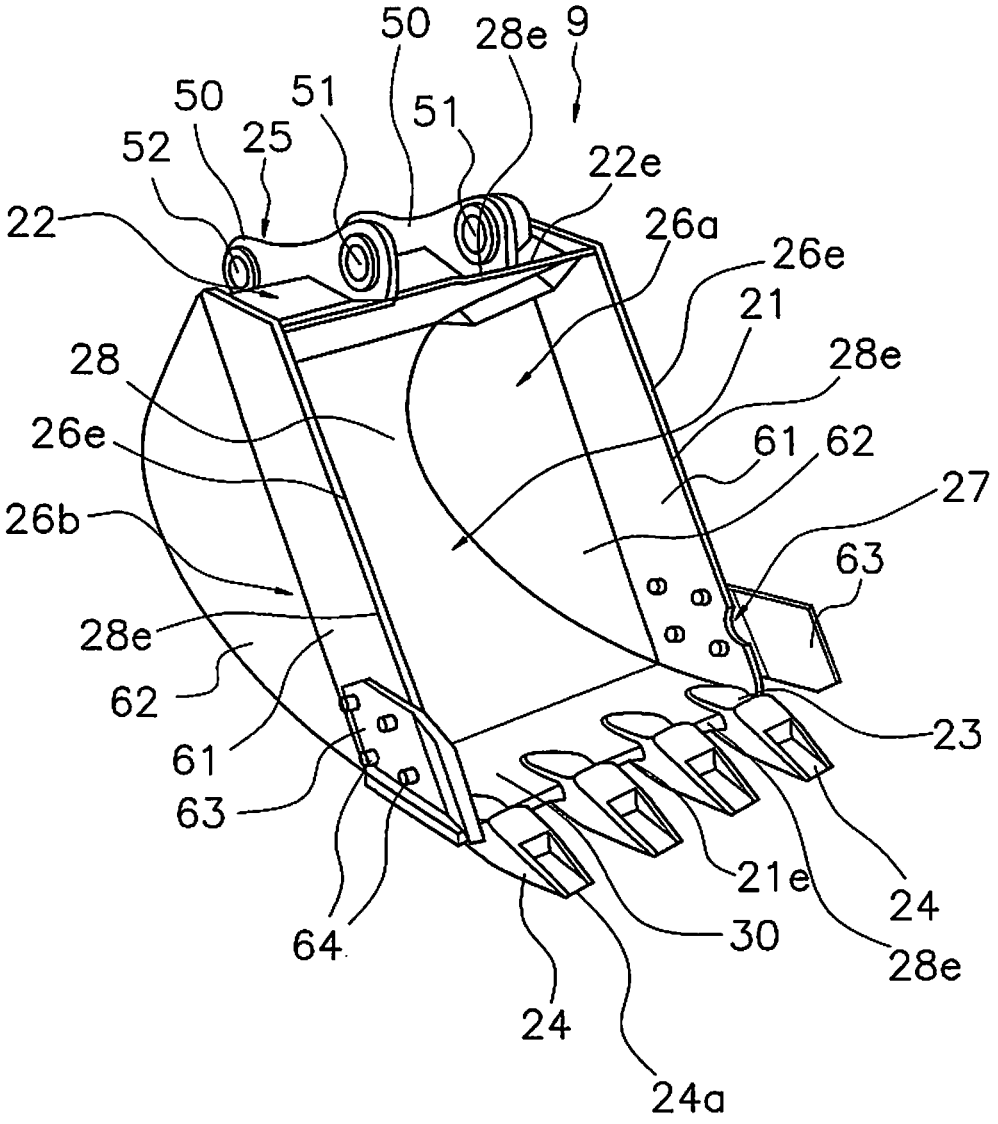
FIG. 2 is an oblique view of the excavation bucket of the hydraulic excavator in FIG. 1.
Figure 3:
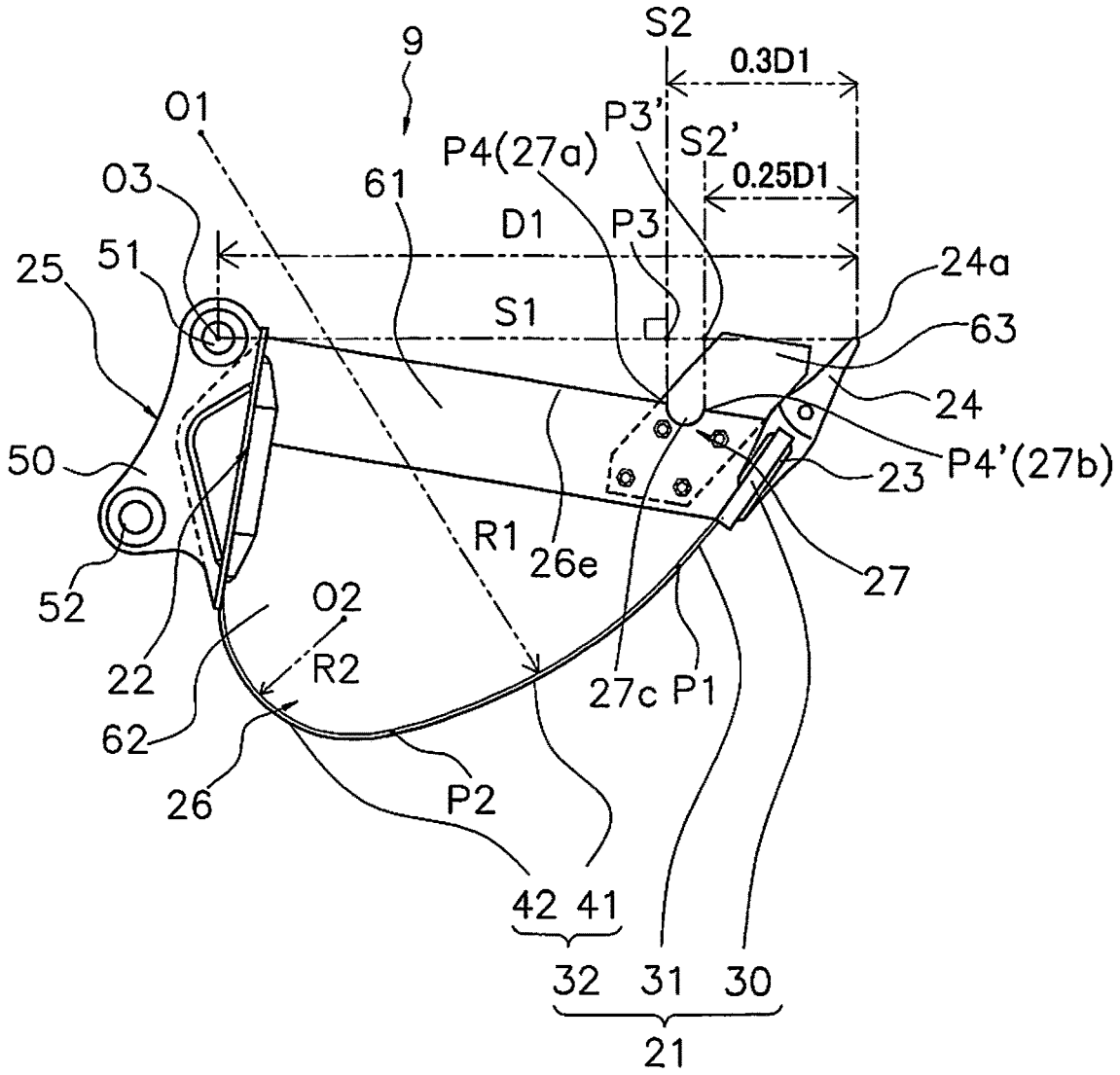
FIG. 3 is a side view of the excavation bucket in FIG. 2.

FIG. 2 is an oblique view of the excavation bucket 9 pertaining to an exemplary embodiment of the present invention. FIG. 3 is a side view of the excavation bucket 9 in FIG. 2, and shows the state when a side wall part 26*b* on the left side face side has been removed.

As shown in FIGS. 2 and 3, the excavation bucket 9 mainly has a bottom face part 21, a rear face part 22, a tooth adapter 23, a plurality of teeth 24, a bracket 25, a pair of side wall parts 26*a* and 26*b*, and target penetration depth display components 27.

The bottom face part 21 has a shape that is curved in side view. The rear face part 22 is linked to the bottom face part 21. The side wall parts 26*a* and 26*b* are disposed opposing each other, and cover the sides of the space bounded by the bottom face part 21 and the rear face part 22. An opening into the external space of the space bounded by the bottom face part 21, the rear face part 22, and the side wall parts 26*a* and 26*b* is shown in the opening 28. Specifically, the edge 28*e* of the opening 28 is formed by the end 21*e* of the bottom face part 21, the end 22*e* of the rear face part 22, and the ends 26*e* of the side wall parts 26*a* and 26*b*.

1-3. Bottom Face Part

The bottom face part 21 has a front lip 30, a front face part 31, and a curved part 32. The front face part 31 is a flat, plate-like member, and has a linear shape in side view. The curved part 32 is a curved, plate-like member, and has a shape that curves outward toward the outside of the excavation bucket 9 in side view. The curved part 32 is linked to the front face part 31.

The curved part 32 has a first curved face part 41 and a second curved face part 42. The first curved face part 41 is linked to the front face part 31. Therefore, the front face part 31 is disposed between the first curved face part 41 and the front lip 30. The first curved face part 41 has a shape that is curved at a specific radius of curvature R1 in side view. The center O1 of the radius of curvature R1 of the first curved face part 41 is located on the outside of the excavation bucket 9.

The second curved face part 42 is located more to the rear face part 22 side than the first curved face part 41, and is linked to the first curved face part 41 and the rear face part 22. The second curved face part 42 has a shape that is curved at a specific radius of curvature R2 in side view. The radius of curvature R2 is smaller than the radius of curvature R1. The center O2 of the radius of curvature R2 of the second curved face part 42 is located on the inside of the excavation bucket 9. In FIG. 3, the boundary between the front face part 31 and the curved part 32 is indicated by P1, and the boundary between the first curved face part 41 and the second curved face part 42 is indicated by P2.

The front lip 30 is a flat, plate-like member, and has a linear shape in side view. The front lip 30 is fixed to the end of the front face part 31, on the edge 28*e* side of the front face part 31. The thickness of the front lip 30 is greater than the thickness of the front face part 31. The front lip 30 is a member to which the tooth adapter 23 is attached and the teeth 24 are fixed. The end 21*e* of the bottom face part 21 corresponds to the end of the front lip 30.

1-4. Rear Face Part and Bracket

The rear face part 22 has a plate-like member. The rear face part 22 is linked to the curved part 32 of the bottom face part 21.

The bracket 25 is used to attach the excavation bucket 9 to the arm 8. The bracket 25 is fixed to the rear face part 22. The bracket 25 has two attachment components 50 that protrude outward from the rear face part 22. These attachment components 50 are plate-like members, and are disposed so that their main faces are perpendicular to the width direction of the excavation bucket 9. The two attachment components 50 are disposed opposite each other with a specific spacing in between.

A first hole 51 and a second hole 52 are formed in each of the attachment components 50. Attachment pins (not shown) for attaching the bracket 25 to the arm 8 are passed through the first holes 51. The second holes 52 are formed on the bottom face part 21 side of the first holes 51, and attachment pins (not shown) for attaching the bracket 25 to the bucket cylinder 12 (see FIG. 1) are passed through these holes.

A plurality of teeth 24 are fixed to the front lip 30 via the tooth adapter 23. The teeth 24 are disposed spaced apart from each other along the end 21*e* of the front lip 30 (see FIG. 2). The teeth 24 have a shape that tapers toward the distal ends 24*a* in side view.

In the following description of the configuration of the excavation bucket 9, the term "front" refers to the distal end 24*a* side of the teeth 24 in the state shown in FIG. 3, and "rear" refers to the first hole 51 side. The above-mentioned center O1 is located above and to the rear of the first holes 51 in side view.

1-5. Side Wall Parts

The side wall parts 26*a* and 26*b* are disposed apart from each other, and cover the sides of the space bounded by the bottom face part 21 and the rear face part 22.

As shown in FIGS. 2 and 3, the side wall parts 26*a* and 26*b* each have a side lip 61, a side plate 62, and a side cutter 63. The side lips 61 are provided on the edge 28*e* side on the side wall parts 26*a* and 26*b*. The side lips 61 are disposed to link the rear face part 22 and the front lip 30. The ends 26*e* of the side wall parts 26*a* and 26*b* correspond to the ends of the side lips 61.

The side plates 62 are provided between the front lip 30 and the bottom face part 21 and rear face part 22, and are connected to the front lip 30 and the bottom face part 21 and rear face part 22.

The side cutters 63 are used when smoothing out wall surfaces, and are fixed by bolts 64 on the outside of the side lips 61.

1-6. Target Penetration Depth Display Components

Figure 4:
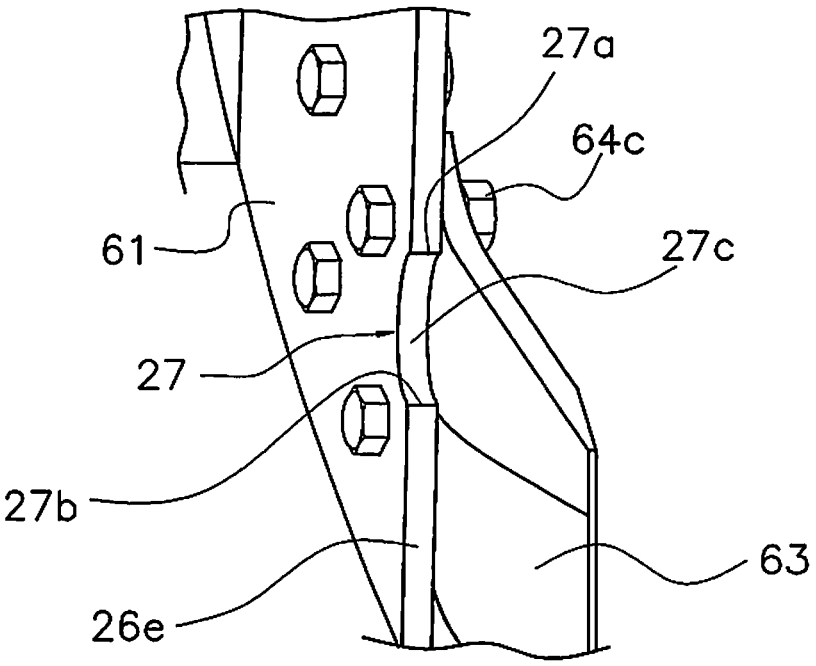
FIG. 4 is an oblique view of the area near a target penetration depth display component of the excavation bucket in FIG. 2.

FIG. 4 is a detail view of the excavation bucket 9.

The target penetration depth display components 27 are provided to the side wall part 26*a* and the side wall part 26*b* to be visible by the operator in the cab, so that the amount of soil scooped up will be appropriate for the capacity of the excavation bucket 9. The target penetration depth display component 27 provided to the side wall part 26*b* is not shown in FIG. 2 because it is hidden behind the side cutter 63.

In this exemplary embodiment, as shown in FIGS. 3 and 4, the target penetration depth display components 27 each have a cut-out 27*c* formed by cutting out the end 26*e* of the side lip 61. The cut-outs 27*c* are semi-circular in side view. The cut-outs 27*c* are formed at positions around the teeth 24 at the ends 26*e* of the side lips 61 that form the edge 28*e* of the opening 28.

As shown in FIG. 3, the length of an imaginary line segment S1 that connects the center O3 of the first holes 51 of the bracket 25 and the distal ends 24*a* of the teeth 24 in side view is defined as the wrist radius D1.

P3 is a position that has moved by a length of 0.30×D1 over the imaginary line segment S1 from the distal ends 24*a* in side view, and S2 is a straight line that passes through the position P3 and is perpendicular to the imaginary line segment S1, then the intersection P4 between the straight line S2 and the ends 26*e* coincides with the ends 27*a* on the rear face part 22 side of the cut-outs 27*c*.

Also, P3' is a position that has moved by a length of 0.25×D1 over the imaginary line segment S1 from the distal ends 24*a* in side view, and S2' is a straight line that passes through the position P3' and is perpendicular to the imaginary line segment S1, then the intersection P4' between the straight line S2' and the ends 26*e* coincides with the ends 27*b* on the teeth 24 side of the cut-outs 27*c*.

The cut-outs 27*c* are thus formed between the position P4 and the position P4'.

The values of 0.25 and 0.30 that are used to determine the positions P4 and P4' will now be described. These values (0.25 and 0.30) are set as the ratio α of the penetration depth Dx to the wrist radius D1. A targeted penetration depth Dx of 0.30×D1 results from performing excavation using the ends 27*a* of the cut-outs 27*c* as the reference, and a targeted penetration depth Dx of 0.25×D1 results from performing excavation using the ends 27*b* of the cut-outs 27*c* as the reference (see below for further details).

1-7. Penetration Depth Dx

Figure 5:
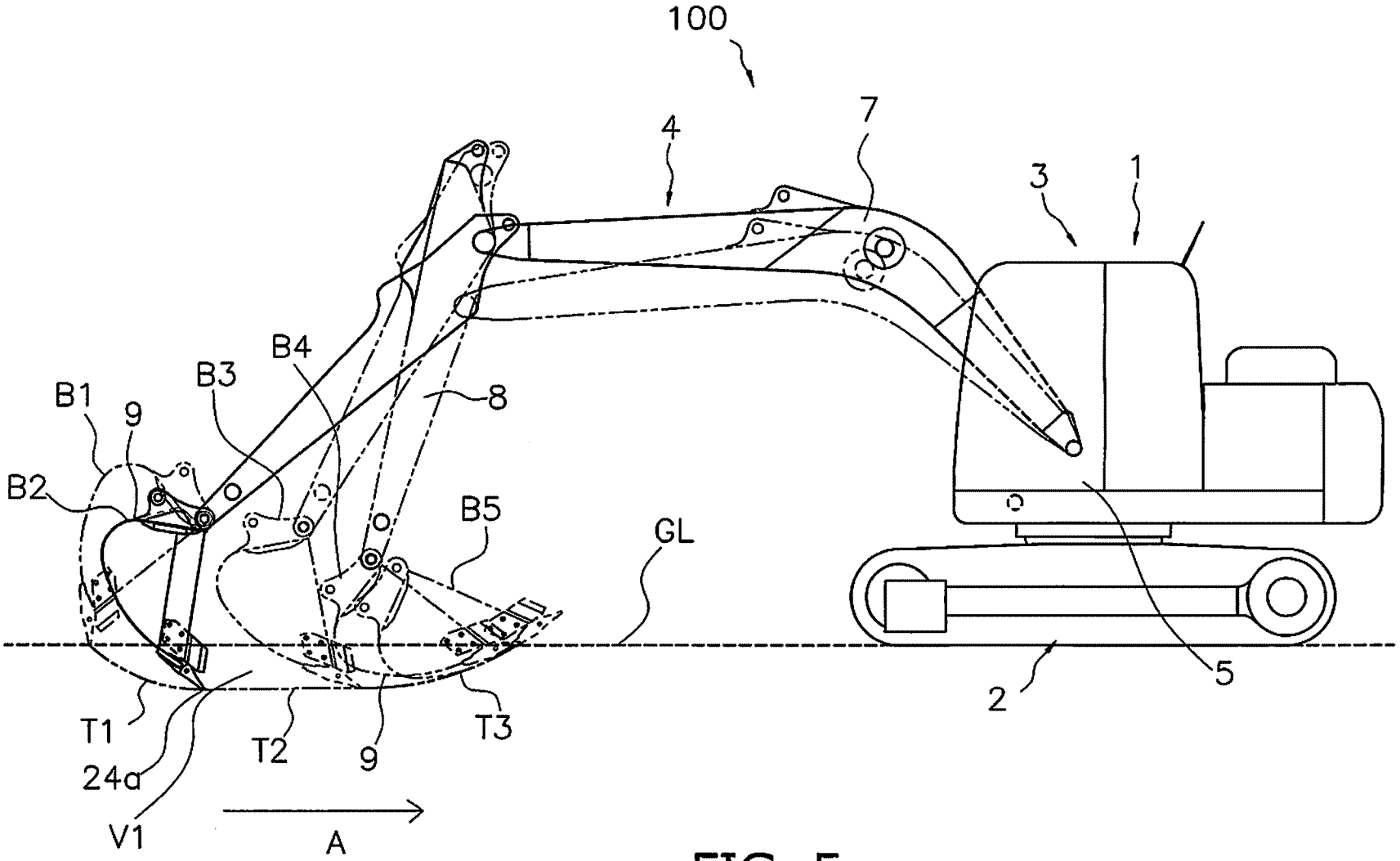
FIG. 5 is a side view of the operation during excavation with the hydraulic excavator in FIG. 1.

The penetration depth Dx will now be described. FIG. 5 is a side view of the operation when excavation is performed using the hydraulic excavator 100 in this exemplary embodiment. The hydraulic cylinders 10 to 12 are controlled to rotate the boom 7, the arm 8, and the excavation bucket 9 and excavate the ground in the direction of the arrow A. The dashed line indicates the ground line GL. The two-dot chain lines T (T1, T2, and T3) indicate the trajectory of the distal ends of the teeth 24. Five states of the excavation bucket 9 are indicated by B1 to B5. Only the state B2 is indicated by a solid line, while B1 and B3 to B5 are indicated by two-dot chain lines.

The teeth 24 penetrate the ground (state B2) when the excavation bucket 9 is rotated from the state B1 in which the distal ends of the teeth 24 are in contact with the ground line GL. In the state B2, the imaginary line segment S1 indicating the wrist radius D1 is disposed perpendicular to the ground line GL. The trajectory of the distal ends of the teeth 24 when the excavation bucket 9 moves from state B1 to state B2 is indicated by T1. The trajectory T1 indicates the movement of the excavation bucket 9 when it penetrates the ground.

The boom 7 and the arm 8 are then driven while rotating the excavation bucket 9, which moves the excavation bucket 9 to the cab 5 side as indicated by the state B3, forming the trajectory T2 that is substantially parallel to the ground line GL. The trajectory T2 indicates the movement of the excavation bucket 9 during linear excavation.

Next, the boom 7 and the arm 8 are driven and the excavation bucket 9 is rotated so that the teeth 24 of the excavation bucket 9 come up above the ground line GL, as shown in the states B4 and B5. The trajectory in which the teeth 24 go from the trajectory T2 and come up above the ground line GL is indicated as T3. The trajectory T3 indicates the movement of the excavation bucket 9 when it is pulled up above the ground.

The volume V1 of soil between the ground line GL and the trajectories T1 to T3 is scooped into the excavation bucket 9 and carried to another place.

Figure 6:
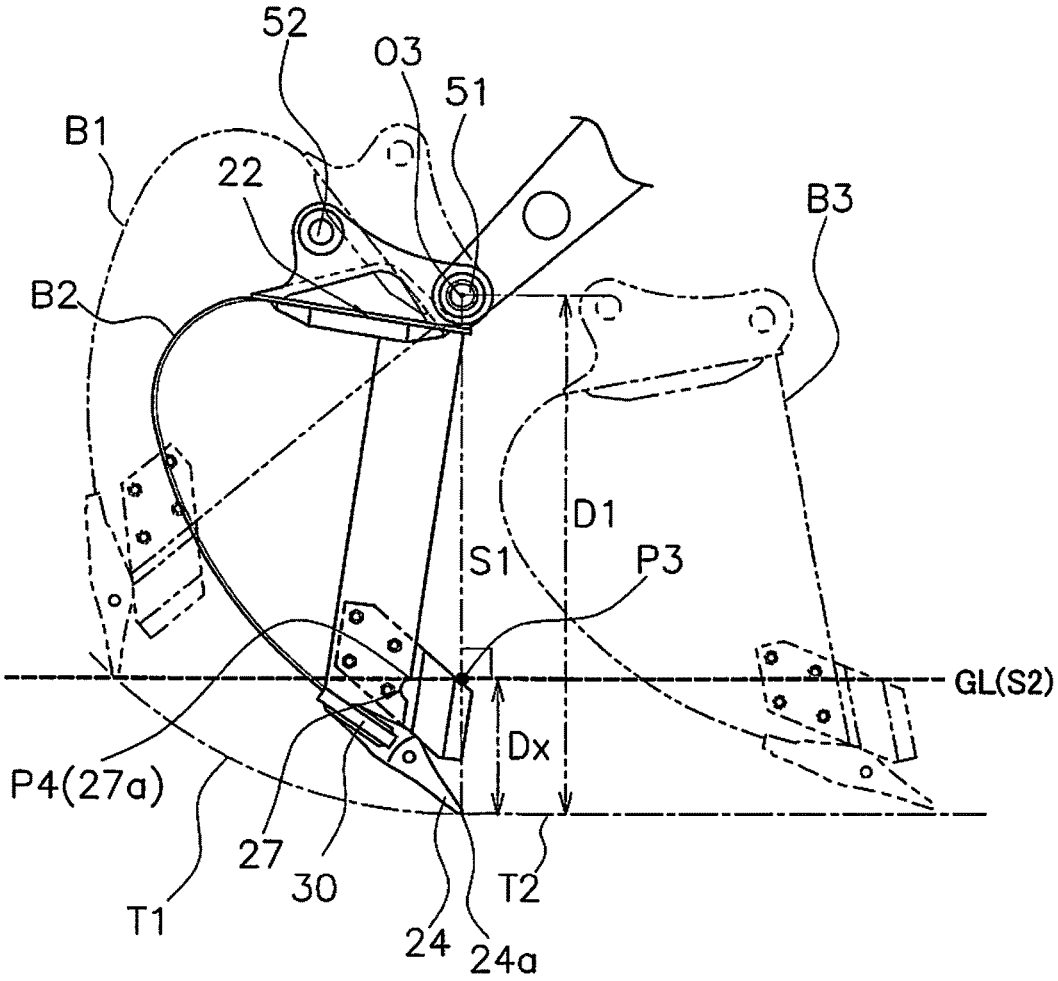
FIG. 6 is a detail view of a portion of FIG. 5.

FIG. 6 is a detail view of FIG. 5. The length from the distal ends 24*a* of the teeth 24 to the ground line GL in the state B2 in which the imaginary line segment S1 indicating the wrist radius D1 is disposed perpendicular to the ground line GL in side view is defined as the penetration depth Dx.

In FIG. 6, the imaginary line segment S2 shown in FIG. 3 coincides with the ground line GL, and the ends 27*a* of the cut-outs 27*c* are disposed on the ground line GL, so the penetration depth Dx is 0.3×D1.

Specifically, in the state B2, when the imaginary line segment S1 is perpendicular to the ground line GL, the operator operates the hydraulic excavator 100 so that the ends 27*a* of the cut-outs 27*c* will coincide with the ground line GL, and can thereby perform excavation at a penetration depth of 0.30×D1, using the target penetration depth display components 27 as a reference.

1-8. Favorable Range of Penetration Depth Dx

Figure 7:
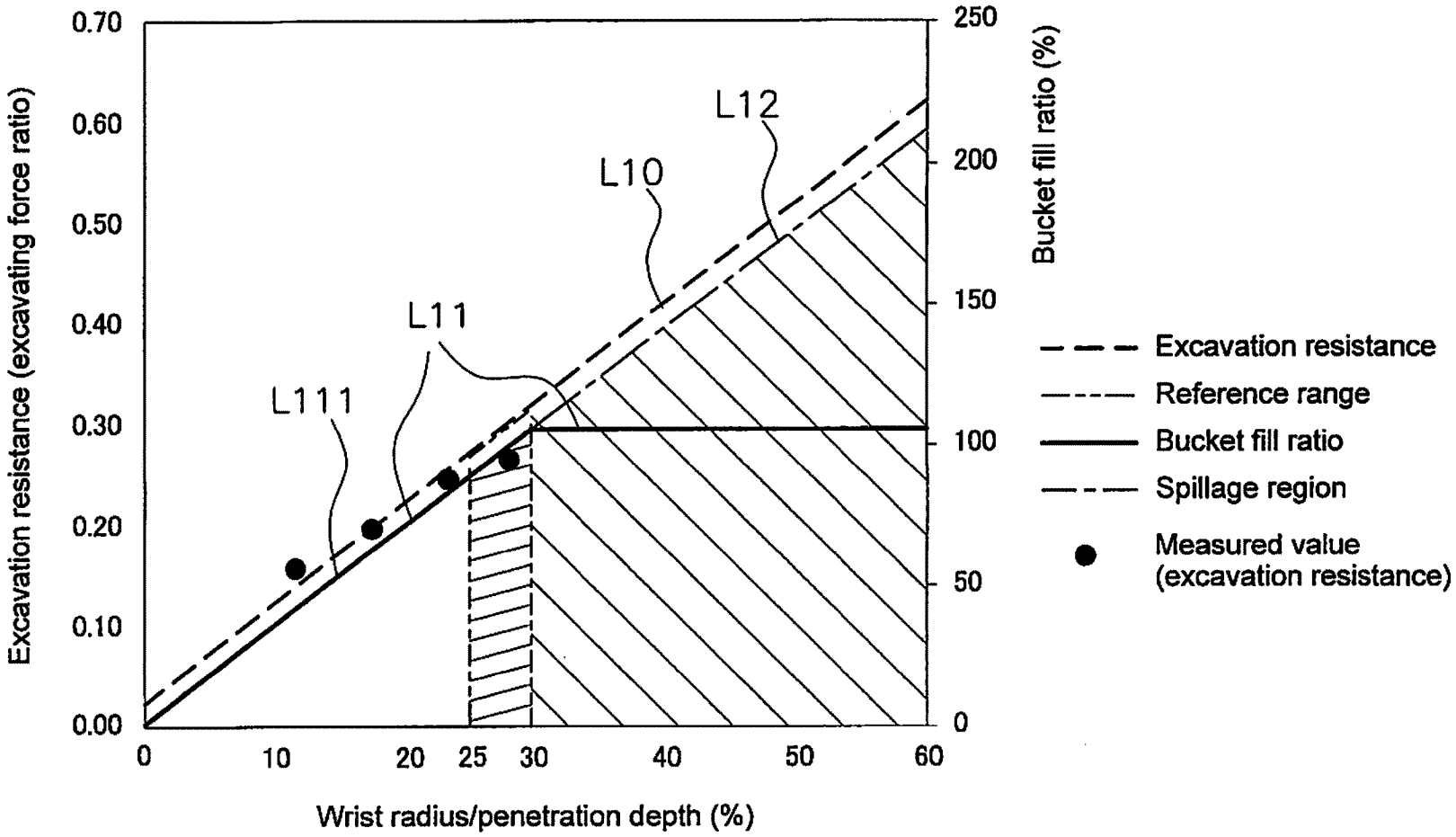
FIG. 7 is a graph of the change in the bucket fill ratio and excavation resistance versus penetration depth.

FIG. 7 is a graph of the change in the bucket fill ratio and the excavation resistance (excavating force ratio) to the ratio α of the penetration depth Dx and the wrist radius D1. In FIG. 7, the ratio α is expressed as a percentage.

The four black dots indicate measured values for excavation resistance (excavating force ratio) when the penetration depth Dx was varied. The excavation resistance is calculated from the pressure of the hydraulic fluid in the bucket cylinder 12. More precisely, Q1 is the hydraulic pressure when soil is actually excavated, and Q2 is the hydraulic pressure when an excavation operation is performed in the air, without excavating any soil, the excavating force ratio is found from the formula (Q1−Q2)/Q2.

It can be seen that the four dots (measured) substantially fall along a dashed line L10. This line L10 is found from the following B,П, Калиочекин's formula (Formula 1).

$$P_1=\mu_1 G+k\ h\ b+\epsilon\ h\ b\ v^2 \qquad \text{Formula 1}$$

$P_1$: horizontal resistance exerted on ground engaging tool (kgf)

$\mu_1$: coefficient of friction between ground engaging tool and soil

G: weight of ground engaging tool (kgf)

k: specific excavation resistance of soil found by experimentation (kgf/m$^2$)

h: penetration depth (m)

b: excavation width (m)

$\epsilon$: coefficient of resistance produced when excavated soil moves to the outside (both sides); average value $\epsilon$=0.1 k V: movement speed of ground engaging tool (m/sec)

The solid line L11 is a plot of the change in the bucket fill ratio versus the penetration depth Dx. A full bucket will now be explained.

Figure 8:
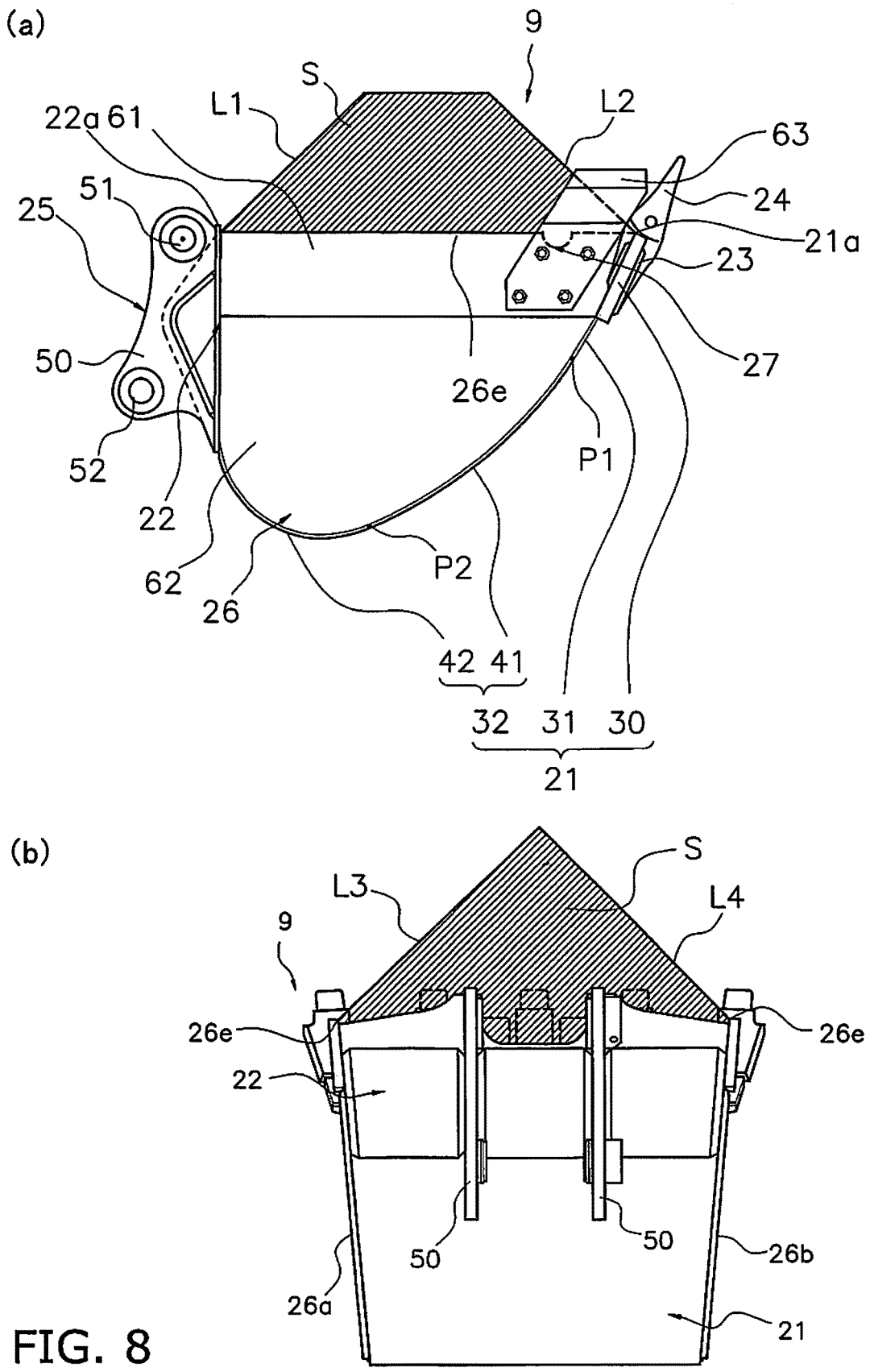
FIG. 8A is a side view illustrating the heaped capacity of the excavation bucket in FIG. 2.
FIG. 8B is a rear view of the heaped capacity of the excavation bucket in FIG. 2.

The term "full" in this embodiment refers to the heaped capacity. FIG. 8A is a side view of the state when the excavation bucket 9 has been filled up with soil. FIG. 8B is a rear view of FIG. 8A.

As shown in FIG. 8A, in a state in which the excavation bucket 9 is disposed so that the ends 26*e* of the side wall parts 26*a* and 26*b* will be horizontal, the load amount of soil S when the soil S is loaded at a 1:1 grade (see lines L1 and L2) from the end 22*a* of the rear face part 22 and the end 21*a* of the bottom face part 21 and, as shown in FIG. 8B, when the soil is loaded at a 1:1 grade (see lines L3 and L4) from the ends 26*e* of the side wall parts 26*a* and 26*b* is defined by JIS (Japan Industrial Standards) as the heaped capacity of the excavation bucket 9.

The solid line L11 in FIG. 7 indicates the quotient obtained by diving the excavated volume versus the ratio of the penetration depth by the bucket capacity. The excavated volume is calculated by multiplying the width of the excavation bucket 9 by the surface area bounded by the ground line GL and the two-dot chain lines T shown in FIG. 5. Also, the one-dot chain line L12 in FIG. 7 indicates the load spillage region. The line L11 has a constant slope up until a specific fill ratio (based on heaped capacity) is reached, and once this specific fill ratio is reached, that specific fill ratio is maintained (does not rise) even if the penetration depth Dx is increased. The specific fill ratio here is a value greater than 100%, but this is because a small amount of spillage is acceptable.

The load spillage region is set on the basis of the heaped capacity in the graph in FIG. 7, but in an actual excavation operation, spillage may occur due to the dryness of the soil, etc., even when the load amount of soil is under the heaped capacity.

As shown in FIG. 7, if the penetration depth Dx is shallow (such as 10%), the excavation resistance will be low and little energy will be used in excavation, but the bucket fill ratio will also be low and transport efficiency will be poor, and as a result the work efficiency for the energy used will be poor. On the other hand, once the load spillage region is reached (such as 55%), excavation resistance rises and more spillage occurs, so energy ends up being wasted.

In view of this, the bucket can be loaded to nearly full and spillage kept low if the ratio $\alpha$ of the penetration depth Dx to the wrist radius D1 is at least 25% and no more than 30%. This is because if the ratio $\alpha$ is 30%, the bucket fill ratio will exceed 100%, but a small amount of spillage is acceptable, as mentioned above.

In this exemplary embodiment, as illustrated in FIG. 3, the ends 27*a* of the cut-outs 27*c* are formed at a position corresponding to a position that has moved by 0.30×D1 over the imaginary line segment S1 from the distal ends 24*a*, and the ends 27*b* of the cut-outs 27*c* are formed at a position corresponding to a position that has moved by 0.25×D1 over the imaginary line segment S1 from the distal ends 24*a*.

Accordingly, the ends 27*a* of the cut-outs 27*c* become a reference when the penetration depth Dx is 30% with respect to the wrist radius D1, and the ends 27*b* of the cut-outs 27*c* become a reference when the penetration depth Dx is 25% with respect to the wrist radius D1. In other words, the target penetration depth display components 27 can also be said to display the penetration depth Dx at which the fill ratio is from 88 to 105%.

As shown in the excavation operation illustrated in FIGS. 5 and 6, the operator can adjust the penetration depth Dx to 0.3D1 by adjusting the movement of the excavation bucket 9 so that the ends 27*a* of the target penetration depth display components 27 are located on the ground line GL in the state B.

Meanwhile, the operator can adjust the penetration depth Dx to 0.25D1 by adjusting the movement of the excavation bucket 9 so that the ends 27*b* of the target penetration depth display components 27 are located on the ground line GL in the state B.

The penetration depth Dx can be adjusted to between 0.25D1 and 0.3D1 by adjusting the movement of the excavation bucket 9 so that the area between the ends 27*a* and the ends 27*b* is located on the ground line GL.

Soil can thus be located in an amount suited to the capacity of the excavation bucket 9 by adjusting the movement of the excavation bucket 9 with using the target penetration depth display components 27 as a reference.

1-9. Visibility of Target Penetration Depth Display Components

Figure 9:
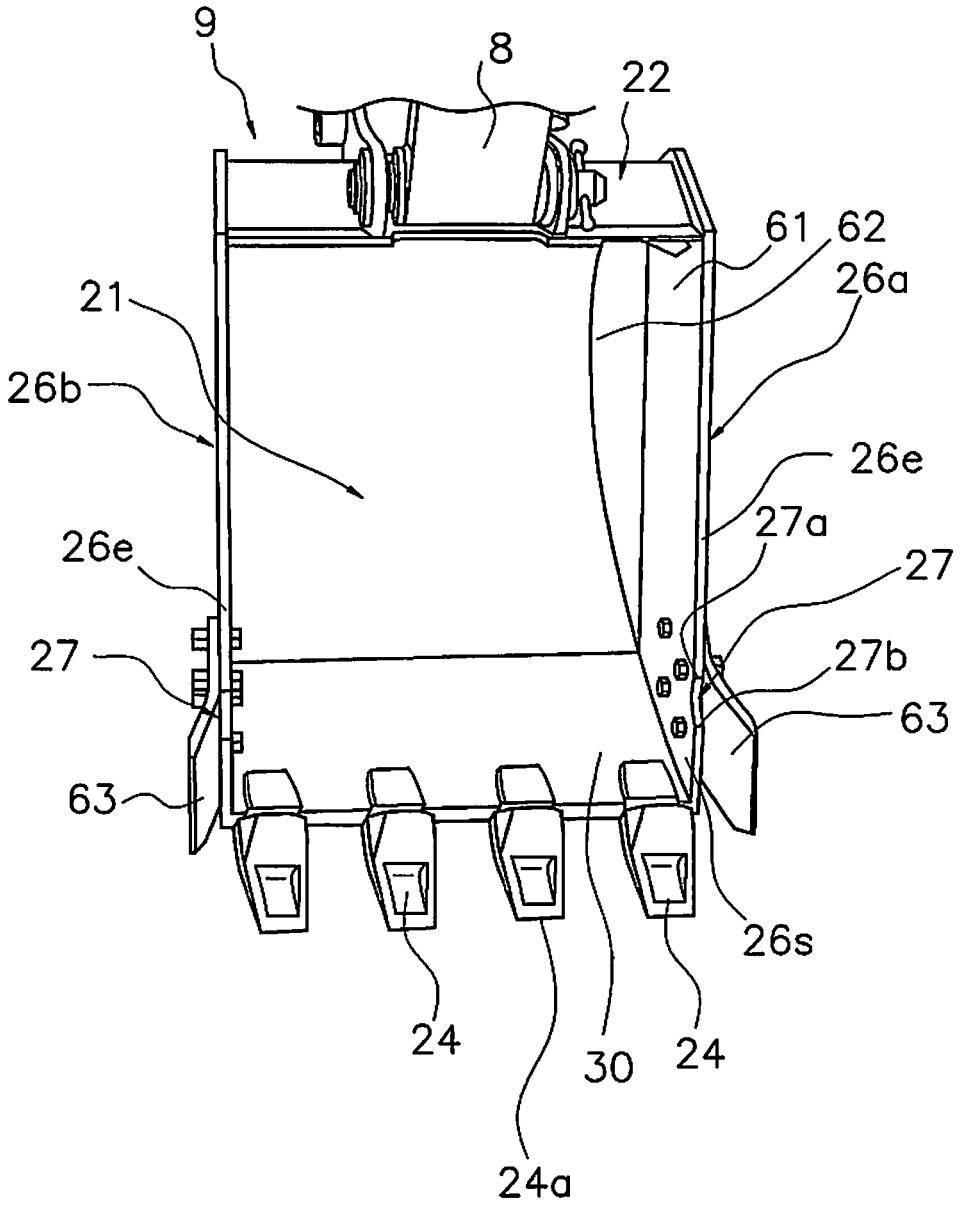
FIG. 9 is an oblique view of a hydraulic excavator as seen from an operator seated in the cab of the hydraulic excavator in FIG. 1.

FIG. 9 shows the state when an operator seated in the driver seat in the cab 5 looks at the excavation bucket. As shown in FIG. 1, the work implement 4 is provided to the right of the cab 5, so from the operator's perspective, the side wall part 26*a*, which is on the right side, is the easier to see of the two side wall parts 26*a* and 26*b*. Also, the face 26*s* on the side wall part 26*b* side (the inside) of the side wall part 26*a* can be said to be even easier to see.

Thus, in this exemplary embodiment, the target penetration depth display component 27 is formed at the end 26*e* of the side wall part 26*a*. The target penetration depth display component 27 is formed as an arc-shaped recess at the end 26*e* of the side wall part 26*a* on the front lip 30 side. The target penetration depth display component 27 has a cut-out 27*c* obtained by cutting out the face 26*s* on the inside of the side wall part 26*a*. Therefore, the operator can easily see these, and is able to operate the excavation bucket 9 by using the target penetration depth display component 27 as a reference, so the proper amount of excavation can be performed.

In this exemplary embodiment, the target penetration depth display component 27 is also formed on the side wall part 26*b* on the left side. This one is harder to see than the one on the side wall part 26*a* side, but the operator can adequately make a visual confirmation of the target penetration depth display components 27.

2. Features 2-1

The excavation bucket 9 in this exemplary embodiment is attached to the arm 8 of the work implement 4 and excavates by penetrating the ground line GL (an example of excavation material), and comprises the bottom face part 21, the rear face part 22, the pair of opposing side wall parts 26*a* and 26*b*, the teeth 24 (an example of a cutting blade), the bracket 25, and the target penetration depth display components 27. The bottom face part 21 has a shape that is curved in side view. The rear face part 22 is linked to the bottom face part 21. The side wall parts 26*a* and 26*b* cover the sides of a space bounded by the bottom face part 21 and the rear face part 22. The teeth 24 are fixed to the end 21*e* of the bottom face part 21 that forms the edge 28*e* of the opening 28 (an example of an opening) of the space formed by the pair of side wall parts 26*a* and 26*b* and the bottom face part 21 and rear face part 22. The bracket 25 is fixed to the rear face part 22 and has a hole formed in it into which is inserted an attachment pin for attaching to the arm 8. The target penetration depth display components 27 are provided around the teeth 24 and near the ends 26*e* of the side wall parts 26*a* and 26*b* that form the edge 28*e* of the opening 28, and display the target penetration depth into the ground line GL. The target penetration depth display component 27 is provided on the inside of at least the side wall part 26*a*, out of the pair of opposing side wall parts 26*a* and 26*b*. The wrist radius D1 is an imaginary line segment S1 that connects the center O3 of the first holes 51 (an example of a hole) in the bracket 25 and the distal end of the teeth 24 in side view, then the target penetration depth display components 27 are provided at the position P4 of the side wall parts 26*a* and 26*b* corresponding to the position P3 that has moved along the imaginary line segment S1 from the distal ends 24*a* toward the first holes 51 by a specific proportional length of the wrist radius D1.

As mentioned above, the target penetration depth display components 27 are provided to the side wall parts 26*a* and 26*b*. Therefore, even when soil should adhere to the side wall parts 26*a* and 26*b* during excavation, the rotational operation of the excavation bucket 9 will cause that soil to slide over the side wall parts 26*a* and 26*b*. Consequently, even when soil adheres to the target penetration depth display components 27, it will readily move away, making it easier to see the target penetration depth display components 27 that display the desired penetration depth.

Therefore, regardless of how experienced the operator is, he will still be able to carry out the excavation work efficiently.

Also, the target penetration depth display components 27 are provided around the teeth 24, near the ends 26*e* of the side wall parts 26*a* and 26*b* that form the edge. Consequently, an amount of soil that is suited to the capacity of the excavation bucket 9 can be excavated by using the target penetration depth display components 27 as a reference.

More specifically, in a state in which the imaginary line segment S1 is facing in the vertical direction in an excavation operation, an amount of soil suited to the capacity can be excavated by operating the hydraulic excavator 100 so that the target penetration depth display components 27 match up with the ground line GL.

As illustrated in FIG. 9, the place on the excavation bucket 9 that is easiest for the operator to see is on the inside of the right side wall part 26*a*. In this exemplary embodiment, the target penetration depth display component is provided at the very least on the inside of the right side wall part 26*a*.

2-2

With the excavation bucket 9 in this exemplary embodiment, the specific ratio α of the wrist radius D1 is 0.5 or less. When the specific ratio α of the wrist radius D1 is greater than 0.5, as shown in FIG. 7, the excavation resistance will be higher and there will be more spillage, and work efficiency in regard to the energy used will suffer. Accordingly, when α is set to 0.5 or less, then energy loss can be reduced and an amount of soil that is suited to the capacity of the excavation bucket 9 can be excavated by using the target penetration depth display components as a reference.

2-3

With the excavation bucket 9 in the above exemplary embodiment, the specific ratio α of the wrist radius D1 is at least 0.25 and no more than 0.30. Consequently, by using the target penetration depth display components 27 as a reference during excavation, spillage from the excavation bucket 9 can be reduced, and the load amount can be prevented from being too small for the bucket capacity, so an amount of soil that is suited to the capacity of the excavation bucket 9 can be excavated.

Thus providing the target penetration depth display component 27 to the face 26*s* on the inside of the side wall part 26*a* of the excavation bucket 9 makes it easier for the operator who is operating the work vehicle from inside the cab 5 to see.

2-4

With the excavation bucket 9 in this exemplary embodiment, the target penetration depth display components 27 are provided on the inside of both of the opposing pair of side wall parts 26*a* and 26*b*. Thus providing the target penetration depth display components on the inside of the side wall parts 26*a* and 26*b* of the excavation bucket 9 makes it easier for the operator who is operating the work vehicle from inside the cab 5 to see them than when they are provided on the outside. Furthermore, forming the side wall parts 26*a* and 26*b* in the same shape reduces the number of different types of parts required.

2-5

With the excavation bucket 9 in this exemplary embodiment, the bottom face part 21 has the front lip 30. The front lip 30 is disposed on the edge 28*e* side of the opening 28, and the teeth 24 are fixed to it. The side wall parts 26*a* and 26*b* have the side lips 61 and the side plates 62. The side lips 61 is disposed on the edge 28*e* side, and is provided to connect the front lip 30 and the rear face part 22. The side plates 62 are provided between the side lips 61 and the bottom face part 21 and rear face part 22. The target penetration depth display components 27 are provided to the side lips 61.

Since the target penetration depth display components 27 are thus provided to the side lips 61, even when soil should adhere, it will move during the excavation, so soil and the like is less likely to remain adhered, which makes the target penetration depth display components 27 easier to see.

2-6

With the excavation bucket 9 in this exemplary embodiment, the side wall parts 26*a* and 26*b* corresponding to a position that is a specific proportional length α of the wrist radius D1 from the distal ends of the teeth 24 is the position P4 at which the line S2, which is perpendicular to the imaginary line segment S1 and passes through the position P3 on the imaginary line segment S1, intersects the side wall parts 26*a* and 26*b*.

Providing the target penetration depth display components 27 at this location allows an amount of soil that is suited to the capacity of the excavation bucket 9 to be excavated.

2-7

With the excavation bucket 9 in this exemplary embodiment, the target penetration depth display components 27 have the cut-outs 27*c* formed in the side wall parts 26*a* and 26*b*. Since cut-outs just need to be formed in the side wall parts 26*a* and 26*b*, it is easy to produce the target penetration depth display components 27. Also, forming these cut-outs, etc., can prevent soil from sticking.

2-8

The excavation bucket 9 in this exemplary embodiment is attached to the arm 8 of the work implement 4 and excavates the ground line GL by penetrating the ground line GL (an example of an excavated material), and comprises the bottom face part 21, the rear face part 22, the pair of opposing side wall parts 26*a* and 26*b*, the teeth 24 (an example of a cutting blade), the bracket 25, and the target penetration depth display components 27. The bottom face part 21 has a shape that is curved in side view. The rear face part 22 is linked to the bottom face part 21. The side wall parts 26*a* and 26*b* cover the sides of a space bounded by the bottom face part 21 and the rear face part 22. The teeth 24 are fixed to the end 21*e* of the bottom face part 21 that forms the edge of the opening 28 (an example of an opening) of the space formed by the pair of side wall parts 26*a* and 26*b* and the bottom face part 21 and rear face part 22. The bracket 25 is fixed to the rear face part 22, and the first holes 51 (an example of a hole) into which are inserted attachment pins for attaching to the arm 8 are formed in this bracket. The target penetration depth display components 27 are provided around the teeth 24 and near the ends 26*e* of the side wall parts 26*a* and 26*b* that form the edge of the opening 28, and displays the target penetration depth into the ground line GL. The target penetration depth display components 27 display a penetration depth such that the fill ratio of the excavation bucket 9 will be at least 88% and no more than 105%.

This allows an amount of soil that is suited to the capacity of the excavation bucket 9 to be excavated. The capacity of the excavation bucket here is the heaped capacity.

2-9

The hydraulic excavator 100 (an example of a work vehicle) in this exemplary embodiment comprises the vehicle body 1, the boom 7, the arm 8, and the excavation bucket 9. The boom 7 is attached to the vehicle body 1. The arm 8 is attached to the boom 7. The excavation bucket 9 is attached to the arm 8.

3. Other Exemplary Embodiments

An exemplary embodiment of the present invention is described above, but the present invention is not limited to or by this exemplary embodiment, and various modifications are possible without departing from the gist of the invention.

(A)

In the above exemplary embodiment, the cut-outs 27*c* are formed to indicate a penetration depth Dx between 0.25×D1 and 0.30×D1, but the target penetration depth display components 27 need not be formed so as to show a range of 0.25×D1 to 0.30×D1. For instance, linear cut-outs may be formed in the ends 26*e* of the side lips 61 so that just one point between 0.25×D1 and 0.30×D1 can be seen.

(B)

The target penetration depth display components 27 in the above exemplary embodiment have the cut-outs 27*c* formed in the side lips 61, but cut-outs are not the only option as long as the targeted penetration depth can be displayed to the operator.

Figure 10:
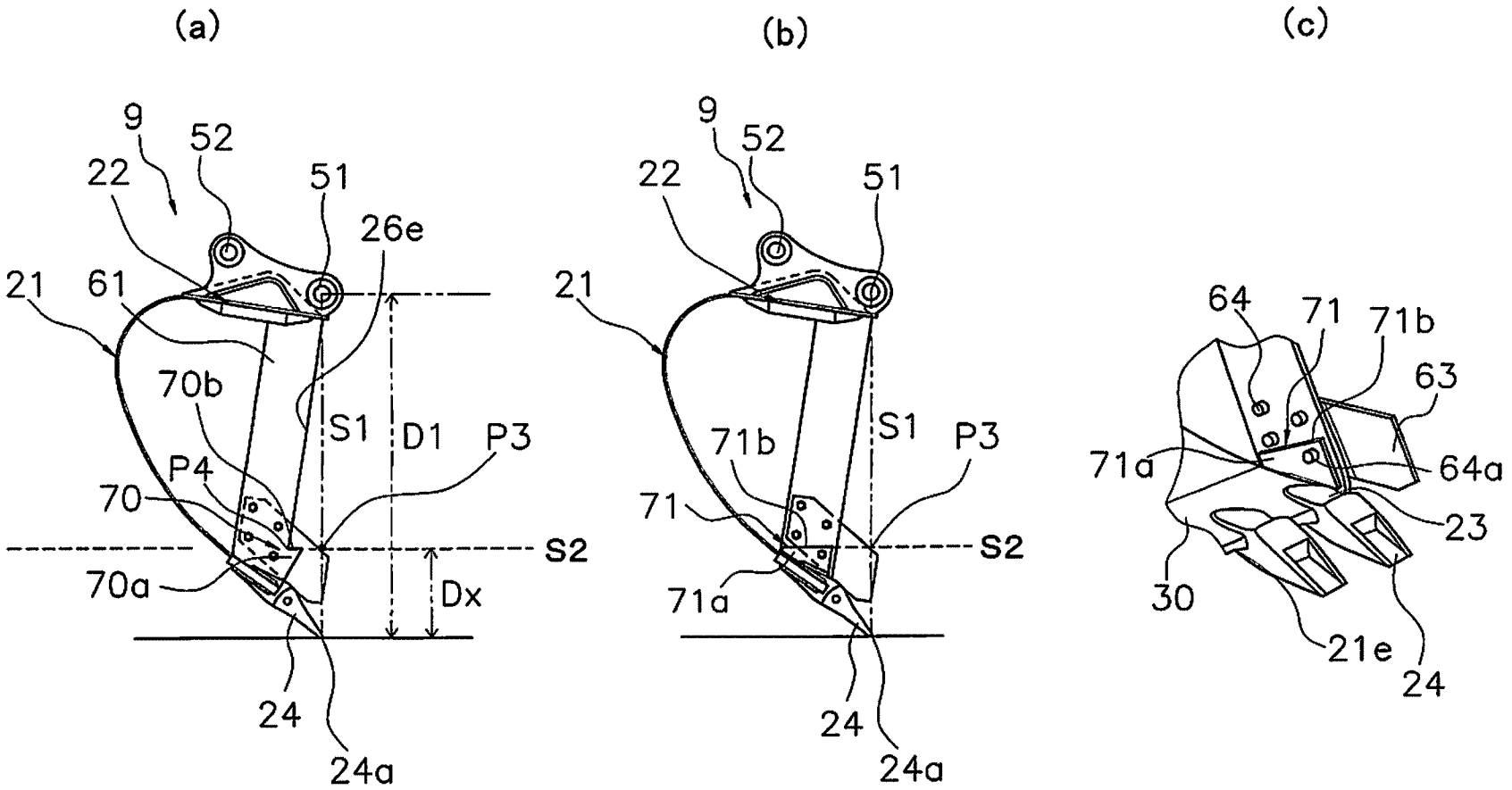
FIG. 10A is a side view of the excavation bucket in a modification example of an embodiment pertaining to the present invention.
FIG. 10B is a side view of the excavation bucket in a modification example of an embodiment pertaining to the present invention.
FIG. 10C is an oblique view of the area near the target penetration depth display component of the excavation bucket in FIG. 10B.

FIGS. 10A and 10B are diagrams of modification examples of the target penetration depth display components 27 in an embodiment, and the side wall part 26*b* is not shown.

For example, a target penetration depth display component 70 having the shape shown in FIG. 10A may be used. The target penetration depth display component 70 has a protrusion 70*a*. The protrusion 70*a* is formed sticking out from the end 26*e* of the side lip 61. In a state in which the imaginary line segment S1 is disposed perpendicular to the ground in side view, P4 is a position at which the straight line S2, which is perpendicular to the imaginary line segment S1 and passes through the position P3 of the penetration depth Dx from the distal ends 24*a* of the teeth 24 on the imaginary line segment S1, intersects the ends 26*e*. The edge 70*b* of the protrusion 70*a* on the rear face part 22 side is formed along the straight line S2 from the position P4. The operator can adjust the penetration depth by using this edge 70*b* of the protrusion 70*a* as a reference. The value of the penetration depth Dx is preferably between 0.25×D1 and 0.30×D1, just as above.

Also, the target penetration depth display component 71 shown in FIG. 10B has a plate-like member 71*a*. FIG. 10C is an oblique view of the part of the excavation bucket 9 near the plate-like member 71*a*. The plate-like member 71*a* preferably has a color that is readily visible to the operator.

As shown in FIGS. 10B and 10C, the edge 71*b* of the plate-like member 71*a* on the rear face part 22 side is formed along the straight line S2 in the state shown in FIG. 10B. The plate-like member 71*a* is fixed to the side lip 61 by using one bolt Ma out of the four bolts 64 that fix the side cutter 63 to the side lip 61. In FIG. 10B, D1 and Dx are not shown, and the same applies to the following drawings.

The side cutters 63 are provided to the excavation bucket 9 discussed above, but the side cutters 63 need not be provided.

(C)

In the above exemplary embodiment, the target penetration depth display components 27 are provided to the side lips 61, but this is not the only option. For instance, they may be provided to the side cutters 63.

Figure 11:
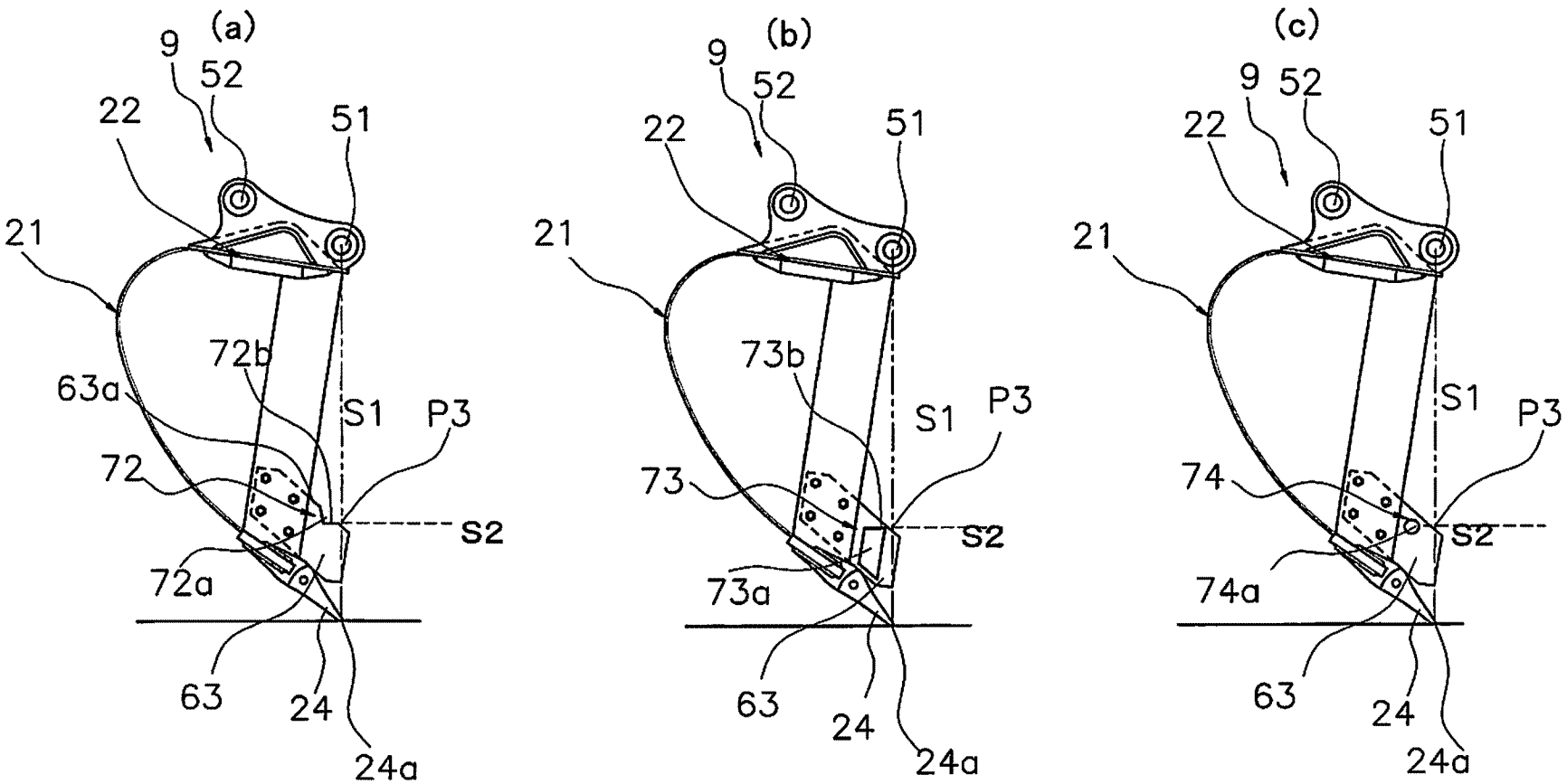
FIGS. 11A to 11C are side views of the excavation bucket in a modification example of an embodiment pertaining to the present invention.

FIGS. 11A to 11C are diagrams of an example in which the target penetration depth display component is formed on the side cutter 63.

The target penetration depth display component 72 shown in FIG. 11A has a cut-out 72*a* formed in the side cutter 63. The cut-out 72*a* is formed by cutting out the end 63*a* of the side cutter 63 on the rear face part 22 side in a triangular shape. In side view, one edge 72*b* forming the cut-out 72*a* is formed to substantially coincide with the above-mentioned straight line S2.

The target penetration depth display component 73 shown in FIG. 11B has a plate-like member 73*a* disposed on the side cutter 63. The plate-like member 73*a* is fixed on the inside of the side cutter 63 (the face on the side of the opposing side cutter 63) by welding or otherwise. The plate-like member 73*a* preferably has a color that is readily visible to the operator.

As shown in FIG. 11B, the end 73*b* of the plate-like member 73*a* on the rear face part 22 side is formed so as to substantially coincide with the straight line S2.

The target penetration depth display component 74 shown in FIG. 11C has a through-hole 74*a* formed in the side cutter 63. This through-hole 74*a* is formed so that it passes through the side cutter 63 from the inside toward the outside. This through-hole 74*a* is provided on the straight line S2 in side view.

(D)

In the above exemplary embodiment, the side cutters 63 are provided to the side lips 61, but the side cutters 63 need not be provided, and shrouds may be provided instead.

Figure 12:
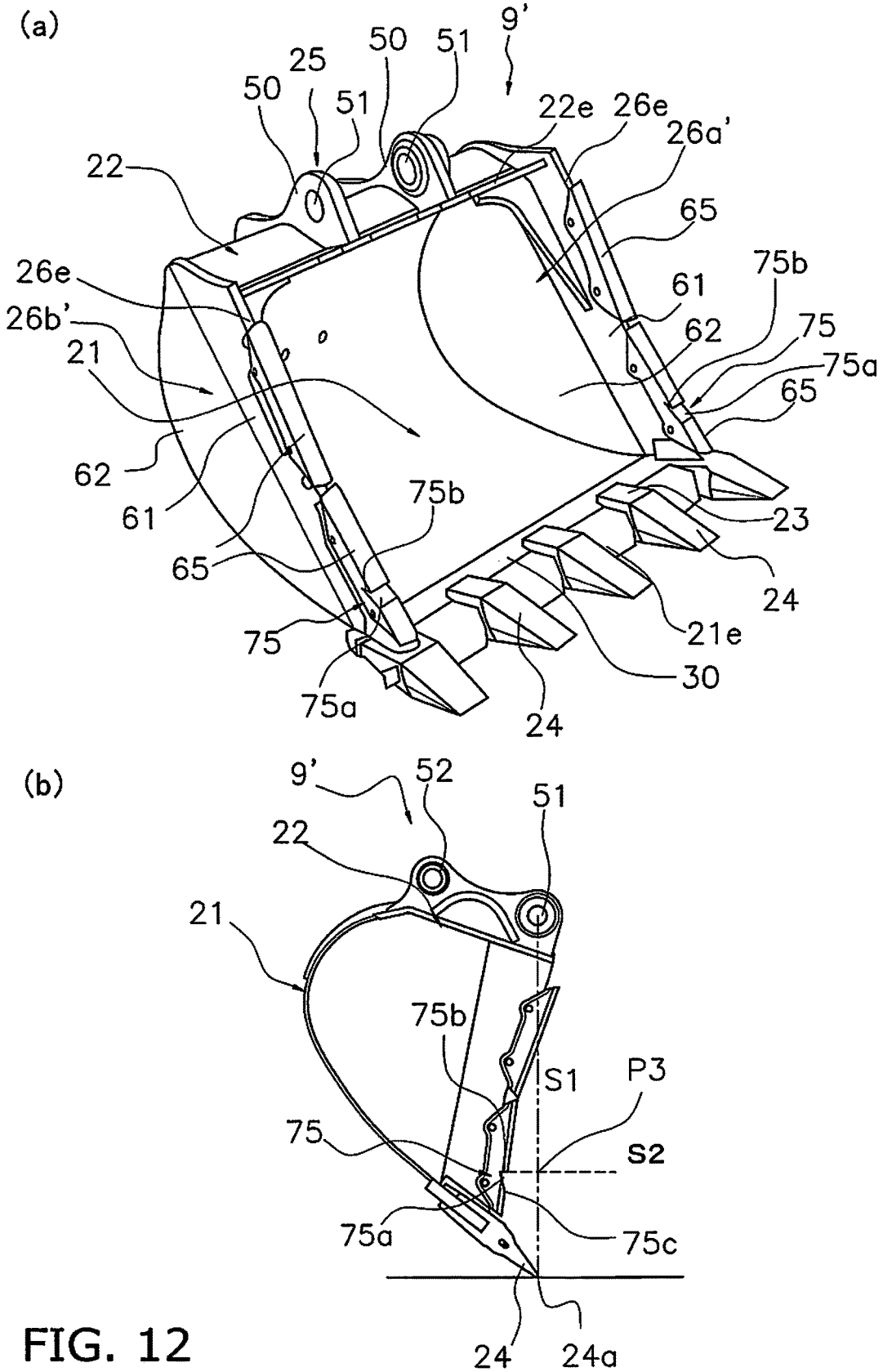
FIG. 12A is an oblique view of the excavation bucket in a modification example of an embodiment pertaining to the present invention.
FIG. 12B is a side view of the excavation bucket in FIG. 12A.

FIG. 12A is a diagram of an excavation bucket 9' provided with shrouds 65. Specifically, the side wall parts 26*a*' and 26*b*' shown in FIG. 12A each have a side lip 61, a side plate 62, and a shroud 65. FIG. 12B is a side view of the excavation bucket 9'. The side wall part 26*b* is not shown in FIG. 12B.

The shrouds 65 serve to protect the ends 26*e* of the side lips 61, and two each are attached to the left and right side lips 61 to cover the ends 26*e*.

A penetration depth display component 75 is provided to the shroud 65 provided on the teeth 24 side of each of the side wall parts 26*a*' and 26*b*'. The penetration depth display components 75 have cut-outs 75*a* formed in the shrouds 65. The cut-outs 75*a* are triangular in side view, and the edges 75*b* forming the cut-outs 75*a* are formed to substantially coincide with the above-mentioned straight line S2. The edges 75*b* may be formed at a position at which the penetration depth Dx is at least 0.25×D1 and no more than 0.30×D1, but if the edges 75*b* are set to a position of 0.30×D1, the ends 75*c* on the teeth 24 side of the cut-outs 75*a* in side view may be set to a position of 0.25×D1.

Figure 13:
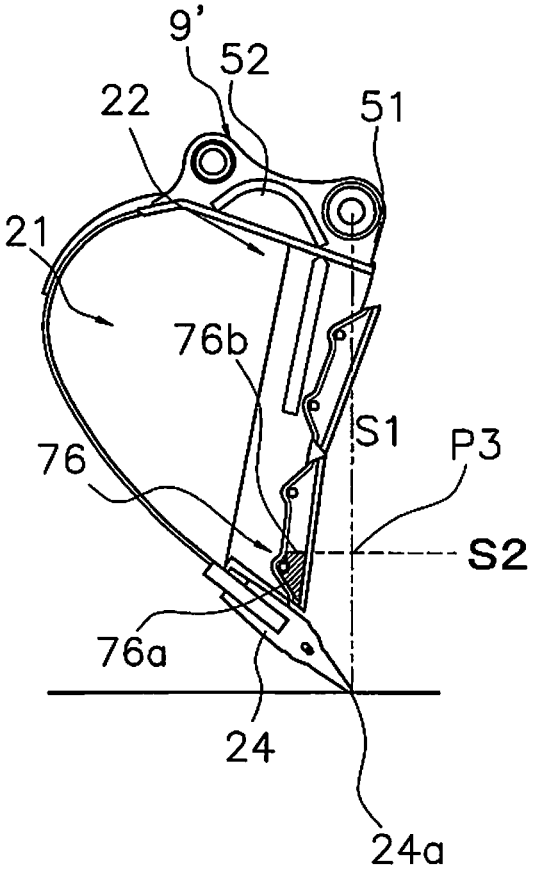
FIG. 13 is a side view of the excavation bucket in a modification example of an embodiment pertaining to the present invention.

Also, plate-like members may be provided on the inside of the shrouds 65, without forming any cut-outs in the shrouds 65. The target penetration depth display component 76 shown in FIG. 13 has a plate-like member 76*a* provided on the inside of the shroud 65. The plate-like members 76*a* preferably have a color that is readily visible to the operator. As shown in FIG. 13, the edges 76*b* of the plate-like members 76*a* on the rear face part 22 side are formed to substantially coincide with the straight line S2 in the state in FIG. 13. Holes may also be formed in the shrouds 65.

The excavation bucket and work vehicle pertaining to exemplary embodiments of the present invention have the effect of making it easier to visually recognize the desired penetration depth, and can be widely applied to various kinds of work vehicle such as hydraulic excavators.

The invention claimed is:

1. An excavation bucket attached to an arm of a work machine to excavate excavation material by penetrating into the excavation material, said excavation bucket comprising:

a bottom face part having a shape that is curved in a side view;

a rear face part linked to the bottom face part;

a pair of opposing side wall parts that cover sides of a space bounded by the bottom face part and the rear face part;

a cutting blade fixed to an end of the bottom face part that forms an edge of an opening of a space formed by the pair of side wall parts and the bottom face part and rear face part;

a bracket fixed to the rear face part, a hole being disposed in the bracket for receiving an attachment pin for attaching to the arm; and a target penetration depth display component provided around the cutting blade and near an end of the side wall part that forms the edge of the opening, and that displays a target penetration depth into the material, the excavation bucket having a wrist radius, the wrist radius being an imaginary line segment that connects a center of the hole in the bracket and a distal end of the cutting blade in a side view, the target penetration depth display component being provided to an inside of at least one of the pair of opposing side wall parts and at a position of the side wall part corresponding to a position that has moved along the imaginary line segment from the distal end toward the hole by a specific proportional length percentage of a length of the wrist radius, and the target penetration depth display component having an arcuate notch formed in an upper edge of one of the side wall parts, the notch overlapping a side wall cutter fixed to the same side wall part as the notch when viewed from a side of the work machine.

2. The excavation bucket according to claim 1, wherein the specific percentage of the wrist radius is 50% or less.

3. The excavation bucket according to claim 2, wherein specific percentage of the wrist radius is at least 25% and no more than 30%.

4. The excavation bucket according to claim 1, wherein the target penetration depth display component is provided to the inside of both of the opposing side wall parts.

5. The excavation bucket according to claim 1, wherein the bottom face part has a front lip disposed on the edge side and to which the cutting blade is fixed, the side wall parts include a side lip disposed on the edge side and provided to connect the front lip and the rear face part; and a side plate provided between the side lip and the bottom face part and the rear face part, and the target penetration depth display component is provided to the side lip.

6. The excavation bucket according to claim 1, wherein the bottom face part has a front lip disposed on the edge side and to which the cutting blade is fixed, the side wall parts include a side lip disposed on the edge side and is provided to connect the front lip and the rear face part;

a side plate provided between the side lip and the bottom face part and the rear face part; and the side cutter fixed to the side lip.

7. The excavation bucket according to claim 1, wherein the position of the side wall part corresponding to a position that has moved along the imaginary line segment from the distal end toward the hole by the specific proportional length of the wrist radius is a position at which a straight line, which is perpendicular to the imaginary line segment and passes through a position on the imaginary line segment, intersects the side wall part in a side view.

8. A work vehicle, comprising:

a vehicle body;

a boom attached to the vehicle body;

an arm attached to the boom; and the excavation bucket according to claim 1, the excavation bucket being attached to the arm.

9. An excavation bucket attached to an arm of a work machine to excavate excavation material by penetrating into the excavation material, said excavation bucket comprising:

a bottom face part having a shape that is curved in a side view;

a rear face part linked to the bottom face part;

a pair of opposing side wall parts that cover sides of a space bounded by the bottom face part and the rear face part;

a cutting blade fixed to an end of the bottom face part that forms an edge of an opening of a space formed by the pair of side wall parts and the bottom face part and rear face part;

a bracket fixed to the rear face part, a hole being disposed in the bracket for receiving an attachment pin for attaching to the arm; and a target penetration depth display component provided around the cutting blade and near an end of the side wall part that forms the edge, and that displays a target penetration depth into the material, the target penetration depth display component having an arcuate notch formed in an upper edge of one of the side wall parts, the notch overlapping a side wall cutter fixed to the same side wall part as the notch when viewed from a side of the work machine, the target penetration depth display component displaying a penetration depth such that a fill ratio of the excavation bucket is at least 88% and no more than 105%, and the excavation bucket having a wrist radius, the wrist radius being an imaginary line segment that connects a center of the hole in the bracket and a distal end of the cutting blade in a side view, the target penetration depth display component being provided to an inside of at least one of the pair of opposing side wall parts and at a position of the side wall part corresponding to a position that has moved along the imaginary line segment from the distal end toward the hole by a specific percentage of a length of the wrist radius.

10. A work vehicle, comprising:

a vehicle body;

a boom attached to the vehicle body;

an arm attached to the boom; and the excavation bucket according to claim 9, the excavation bucket being attached to the arm.

* * * * *